US005240189A

United States Patent [19]

Majkrzak et al.

[11] Patent Number: 5,240,189

[45] Date of Patent: Aug. 31, 1993

[54] DEBRIS SHREDDER AND ROTOR

[75] Inventors: David S. Majkrzak; Patrick M. Cronin, both of West Fargo; Duane J. Antonsen, Fargo, all of N. Dak.

[73] Assignee: Crary Company, West Fargo, N. Dak.

[21] Appl. No.: 782,247

[22] Filed: Oct. 25, 1991

[51] Int. Cl.[5] ..... B02C 13/16; B02C 13/288

[52] U.S. Cl. ..... 241/55; 241/92; 241/101.7; 241/194

[58] Field of Search ..... 241/55, 92, 101.7, 194

[56] References Cited

U.S. PATENT DOCUMENTS

| | | | |
|---|---|---|---|
| 1,759,905 | 5/1930 | Keith | 241/56 X |
| 2,312,612 | 3/1943 | Wetmore | 146/107 |
| 2,578,850 | 12/1951 | Small | 241/55 X |
| 2,706,372 | 4/1955 | Blydenburgh | 241/101.7 X |
| 3,260,468 | 7/1966 | Beard | 241/55 X |
| 3,410,495 | 11/1968 | Eklund | 241/92 X |
| 3,643,879 | 2/1972 | Palyi | 241/55 |
| 3,674,220 | 7/1972 | Tupper et al. | 241/186 R |
| 3,688,479 | 9/1972 | Martinson et al. | 241/101.7 X |
| 3,712,353 | 1/1973 | Ferry | 241/27 |
| 3,790,986 | 2/1974 | Burger | 241/101.7 X |
| 3,872,654 | 3/1975 | Brundage et al. | 241/101.7 X |
| 3,968,938 | 7/1976 | Ruhl et al. | 241/101.7 X |
| 3,989,198 | 11/1976 | Blasko | 241/101.7 |
| 4,057,952 | 11/1977 | Brokaw | 241/101.7 X |
| 4,101,080 | 7/1978 | Schmidt | 241/194 X |
| 4,597,253 | 7/1986 | Blümer et al. | 56/13.4 |
| 4,696,432 | 9/1987 | Russ et al. | 241/101.7 |
| 4,834,302 | 5/1989 | Baker | 241/92 |
| 5,018,672 | 5/1991 | Peck et al. | 241/55 X |

FOREIGN PATENT DOCUMENTS 3139775 4/1983 Fed. Rep. of Germany ... 241/101.7

OTHER PUBLICATIONS

Original brochure for Crary BEAR CAT Chipper/Shredder Over Power Yardwaste, publication date unknown.

Copy of a brochure for Troy-Bilt Tomahawk ® Chipper/Shredder, copyright 1989, publication date unknown.

*Primary Examiner*—Frank T. Yost
*Assistant Examiner*—Raymond D. Woods
*Attorney, Agent, or Firm*—Kinney & Lange

[57] ABSTRACT

An apparatus for shredding debris from lawns and trees, such as twigs, leaves and like material has a housing in which a rotor is rotatably mounted about an upright axis. The plane of the rotor is thus generally horizontal and supported on a frame which permits movement across the ground. A vertical shaft engine is mounted on the upper side of the housing and supports the rotor within the housing cavity. The rotor has blades which generate an air flow as the rotor is rotating, to provide a vacuum in the center portions of the rotor. The vacuum draws material through a central opening in the bottom of the housing, and the blades impel the material outwardly toward pivotally mounted shredder blades at the outer periphery of the rotor. The rotor also mounts chipper blades in an upper surface thereof with an upwardly extending guide chute receiving limbs and guiding such limbs into the path of the chipper blades as the rotor is rotated, to chip branches, limbs and the like.

20 Claims, 5 Drawing Sheets

FIG. 7
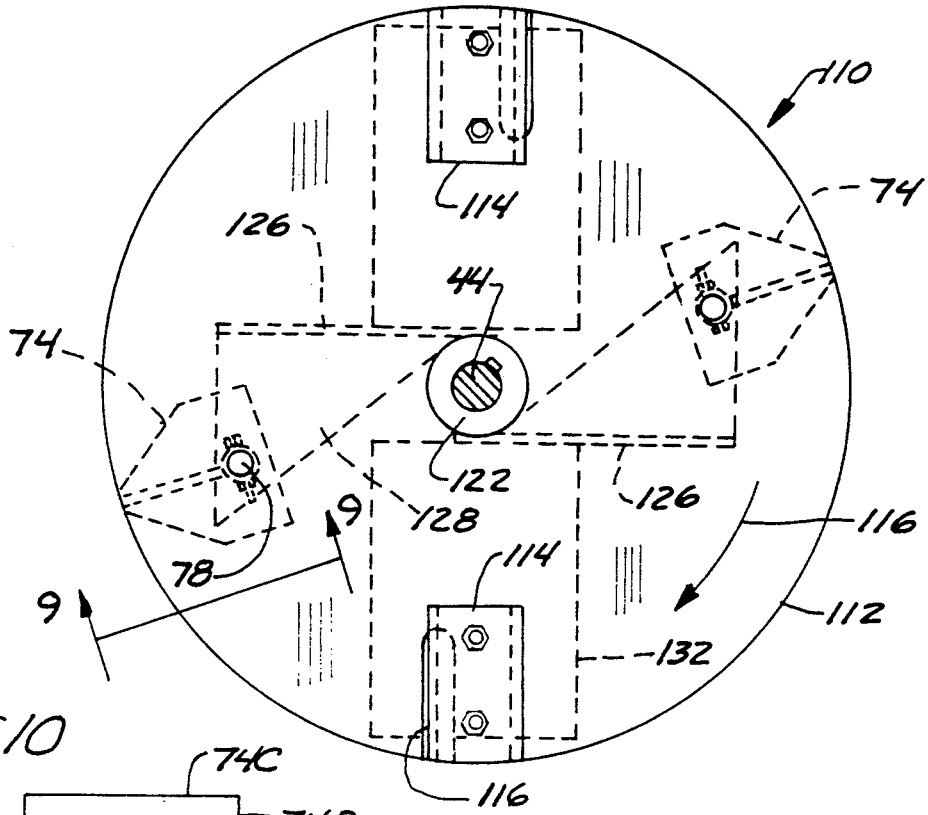
FIG. 10
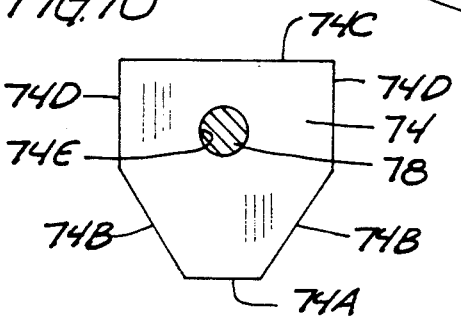
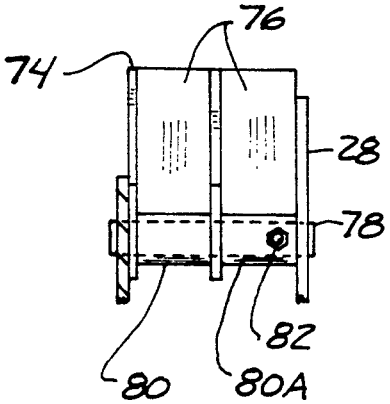
FIG. 9
FIG. 8
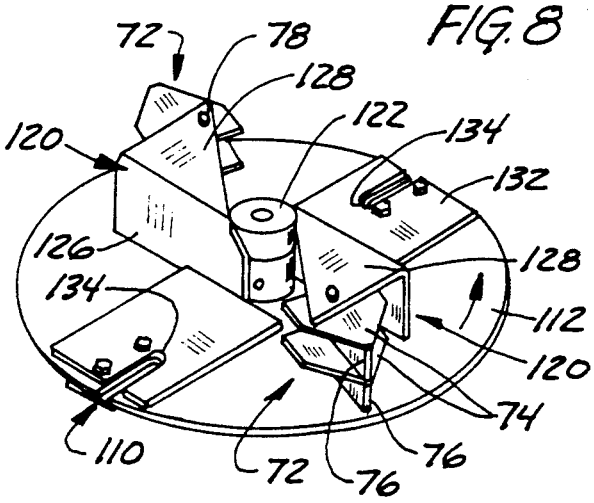

DEBRIS SHREDDER AND ROTOR

BACKGROUND OF THE INVENTION

The present invention relates to a shredder for permitting the shredding of leaves, lawn trash, twigs and the like, and which utilizes a direct drive vertical shaft power unit that drives a rotor providing fan blades for vacuum feed in the center of the rotor and having shredding blades at the outer periphery for shredding material. A separate sleeve or chute for feeding larger diameter limbs from trees for chipping is provided, along with a plurality of chipping blades that are mounted on the rotor.

In the prior art, various devices for chipping and shredding materials have been advanced. U.S. Pat. No. 3,674,220 shows a chipper shredder device that utilizes a vertical shaft for mounting a rotor, but which has an engine for driving the shaft through a belt and pulley arrangement. The feed for chipping and for shredding are both from above the rotating shredding flails and chipping knife. A separate hopper for holding material to be shredded is at the upper side of the unit.

Conventional shredders which utilize horizontal shaft rotors for providing shredding action have been advanced. One such unit is made by Troy-Bilt Manufacturing Co. of Troy, New York, and sold under the trademark TOMAHAWK ®. It is a portable unit that has a top leaf or debris hopper and a side sleeve or chute that permits insertion of material to be chipped laterally into the rotor. The material is discharged laterally adjacent the bottom of the unit.

Another chipper shredder is sold by the assignee of the present application, Crary Company, under the trademark BEARCAT ®. The chipper shredder sold by Crary Company uses a rotor rotating about a horizontal axis with a leaf and debris supply hopper mounted above the rotor, and with a lateral discharge near the bottom of the rotor. The rotor utilizes serrated sickle knife sections for shredder blades, and such knife sections are also used in the present device.

SUMMARY OF THE INVENTION

The present invention relates to a chipper shredder that is of a size convenient for use by a home owner, easily portable, and which as shown has a rotor that is mounted on a vertical shaft within a housing. The rotor is a two-stage fan type rotor having blades designed for generating an air flow that creates a suction or vacuum in the center portions, and a second peripheral stage that has pivoting shredder blades near the outer periphery of the rotor. The housing is made so that the material for shredding is introduced through a forwardly directed port that has a passageway leading into the center of the blower. There is thus a vacuum feed of material to be shredded, such as twigs and leaves. The rotor blades extend from the center of the rotor outwardly and urge the material introduced outwardly, where it is then shredded by the action of the pivoting shredding blades. The material that is shredded is discharged laterally or to the side of the housing. Feeding is accomplished by a flow of air into the center of the rotor and from there material is moved with air by fan blades into the second stage of the rotor, comprising the shredder blade assemblies, which also include spacers acting as further fan blade assemblies.

The unit is powered with a vertical shaft engine that is mounted on the top of the housing. The frame is supported on suitable wheels for portability, and a handle for movement of the unit is provided. The engine can be a standard lawn mower type internal combustion engine of suitable horsepower.

The chipping section comprises an upwardly extending sleeve or chute leading to an opening in the top of the rotor housing that is aligned with the path of a plurality of chipping blades on the upper side of the rotor. When branches or limbs are passed into the chute, they will engage the chipping blades and be chipped. The chip will be discharged laterally out at the same outlet as the shredded material that is taken in through the center, downwardly facing intake opening.

The chipper shredder can be used for providing vacuum or blowing force for other jobs besides merely chipping or shredding, because of vacuum and outlet air flows generated by the rotor fan blades so that it has quite wide versatility and application. A remote tube or hose can be attached to the inlet or outlet of the housing for other uses. With suitable capacities the intake duct can be used with a guide housing having a downward opening inlet that can be used to vacuum driveways, sidewalks and the like. The remote extension hose provides for remote blowing jobs, such as cleaning and blowing leaves into a desired area. By moving the chipper shredder along areas where there are leaves, the vacuum will suck the leaves in for shredding, and when an optional rear bagging attachment is provided, much like on a lawn mower, shredded leaves can be bagged as the unit is moved across the lawn.

BRIEF DESCRIPTION OF THE DRAWINGS

FIG. I is a side elevational view of a chipper shredder made according to the present invention;

FIG. 3A is a fragmentary view similar to FIG. 3 showing a vacuum hose attachment and an outlet deflector;

FIG. 7 is a top plan view of a rotor having a modified shredding assembly from that shown in FIG. 4;

FIG. 8 is a perspective view of the rotor of FIG. 7 showing the bottom of the rotor;

FIG. 9 is an enlarged fragmentary side view of an assembly of shredding flails on the rotor of the present invention taken along line 9—9 in FIG. 7; and FIG. 10 is a plan view of a typical shredder knife used with the present invention.

DETAILED DESCRIPTION OF THE PREFERRED EMBODIMENTS

Figure 2:
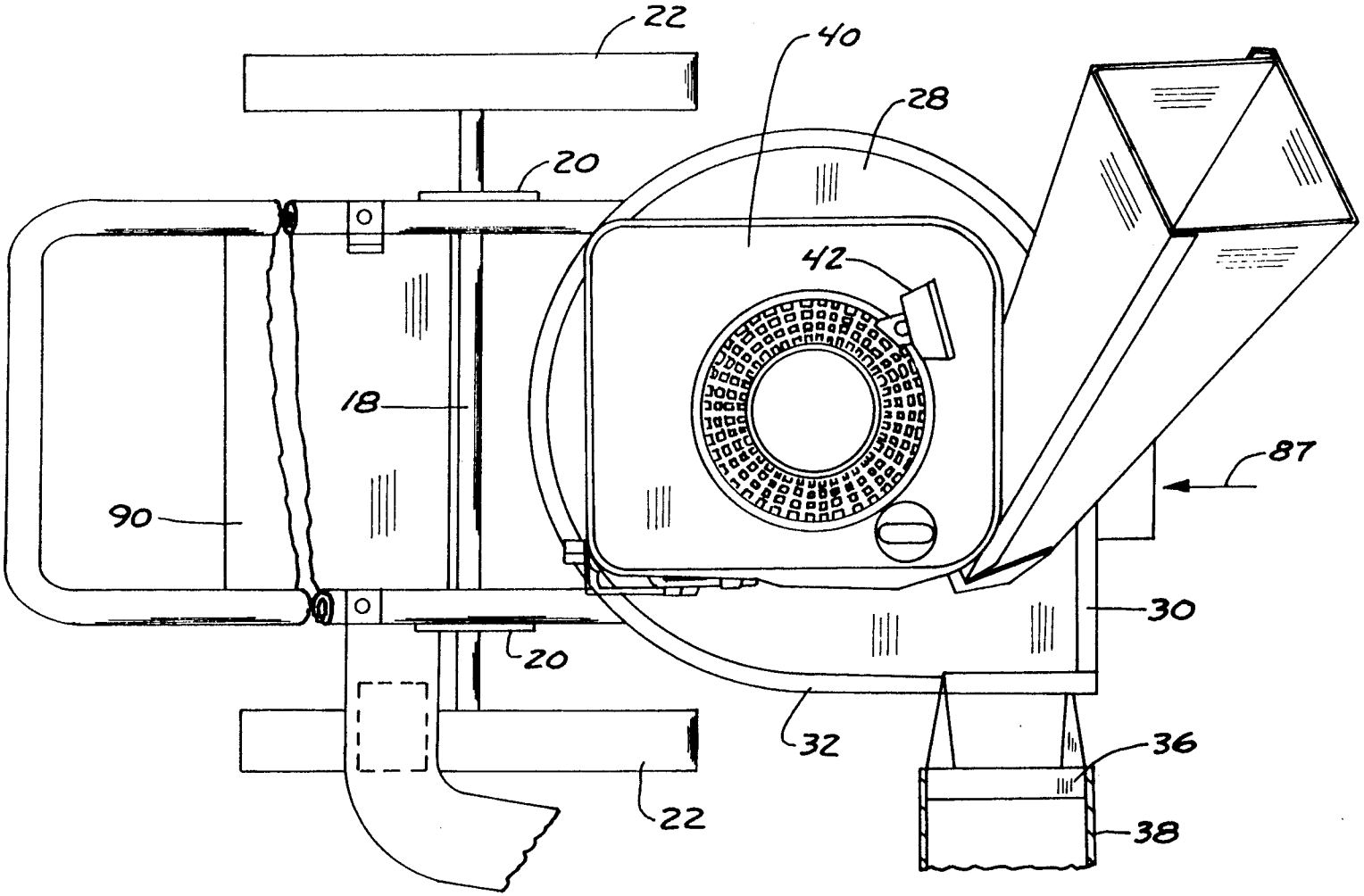
FIG. 2 is a top plan view thereof.
Figure 3:
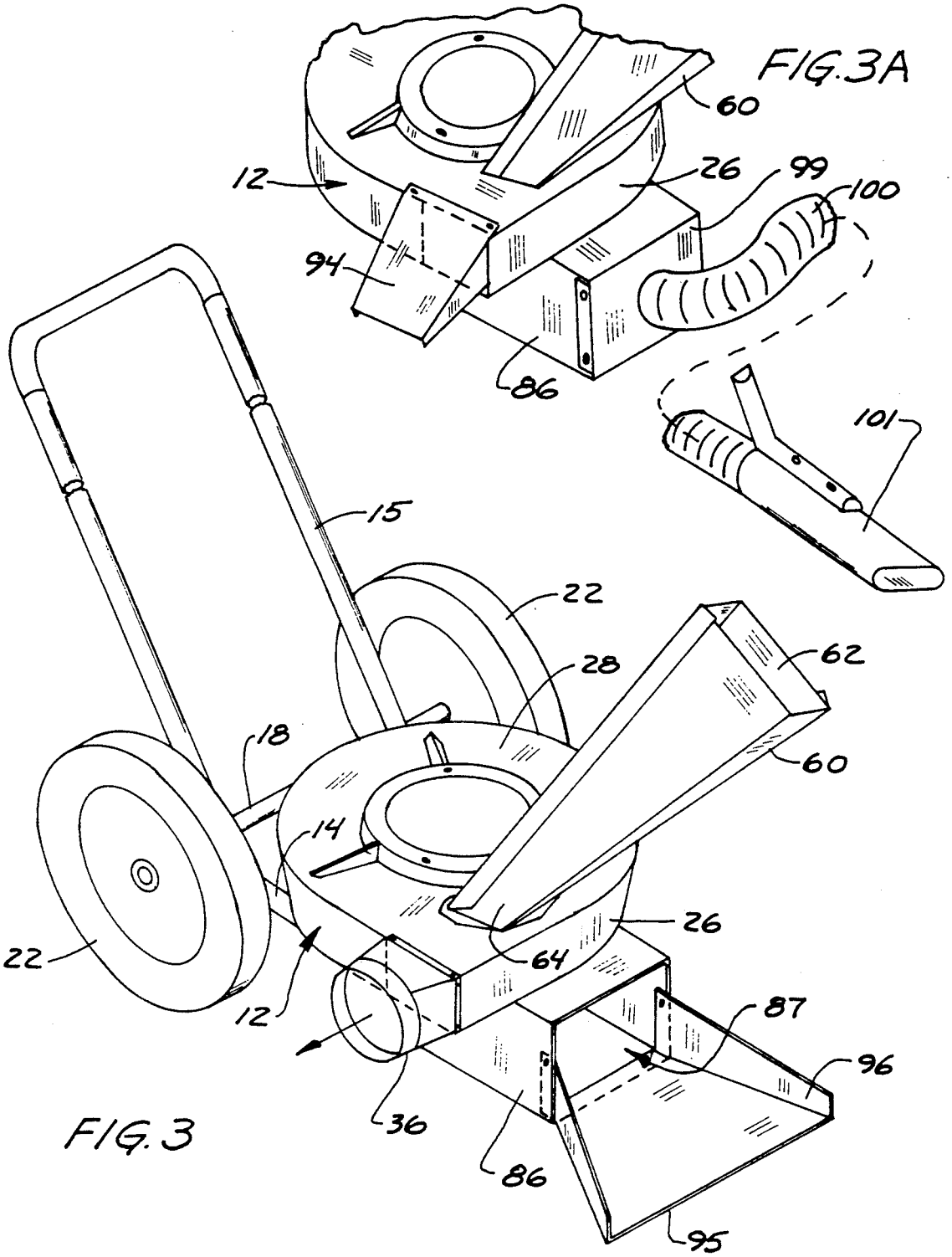
FIG. 3 is a perspective view of the chipper shredder of the present invention with the engine removed to show details of the rotor housing and intake chute.

A chipper shredder machine illustrated generally at 10, as shown in FIGS. I and 2, comprises a housing 12 that forms a main support for the machine. Frame members 14 are attached to the housing and a handle 15 is supported by the frame members. The handle 15 can be of any conventional design and is shown only schematically. The handle is used for mounting an axle (FIG. 2) indicated at 18 on suitable brackets 20. The axle rotatably mounts support wheels 22 of suitable size. The frame members 14 are fastened to a bottom plate or wall 24 of the housing 12. The housing 12 also has a curved side panel or wall 26 which is formed to encircle a top plate or wall 28 of the housing, and form a rotor housing. The rotor housing defines an interior cavity. The side panel wall 26 has a straight section 30 at the front as shown in FIG. 2, as well as a straight section 32 along one lateral side. An outlet opening indicated generally at 34 is provided adjacent these wall sections at a front corner. A connection pipe 36 is formed at the outlet opening to which a suitable extension hose, such as that illustrated schematically at 38, can be attached for use for remote blowing. The hose 38 can be a short nozzle that is ducted downwardly for blowing off a support surface. Also as shown in FIG. 3A, a pivoting deflector 94 can be mounted over the outlet when pipe 36 is removed. The hose 38 or a solid duct can be used with a leaf bag carried on the handles.

An engine 40 is mounted onto the top plate 28 in a known manner, such as by using bolts for bolting it in place, as on a lawn mower. The engine 40 is a conventional internal combustion engine that is well known in the field and it can have a starter handle 42 for pull start. The engine is selected to provide power to a vertically oriented output shaft 44, which extends from the engine into the rotor housing compartment or cavity indicated generally at 46 in FIG. 5.

The shaft 44 will be rotated under power, and is made to support and drive a rotor assembly indicated generally at 48 in the first form of the invention. The rotor assembly 48 has a central hub 50 which is keyed and suitably fastened to the drive shaft 44 of the engine, and is rotated when the engine is running. The rotor assembly 48 comprises a support disk or plate 52 that is welded to the hub 50. The plate is solid and generally planar and has a pair of elongated, radially extending slots 56 defined therethrough on opposite sides. The slots are positioned adjacent the periphery of the plate 52. Chipper blades 58 are mounted to the upper surface of plate 52 and having sharpened edges that overlie a portion of the respective slot. The blades will be used for chipping limbs or the like that are inserted through a limb guiding chute or sleeve 60 that is attached to the upper wall 28 of the housing and extends upwardly at a selected angle. The chute 60 is a tube of suitable cross-sectional shape that tapers from a large inlet opening 62 to a smaller end 64 that is fastened to and opens through an aperture in the top plate 28, which overlies the path of travel of the chipper blades. When limbs are placed through the chute, they will be contacted by the chipper blades on the top of the plate 52 of the rotor assembly.

Figure 4:
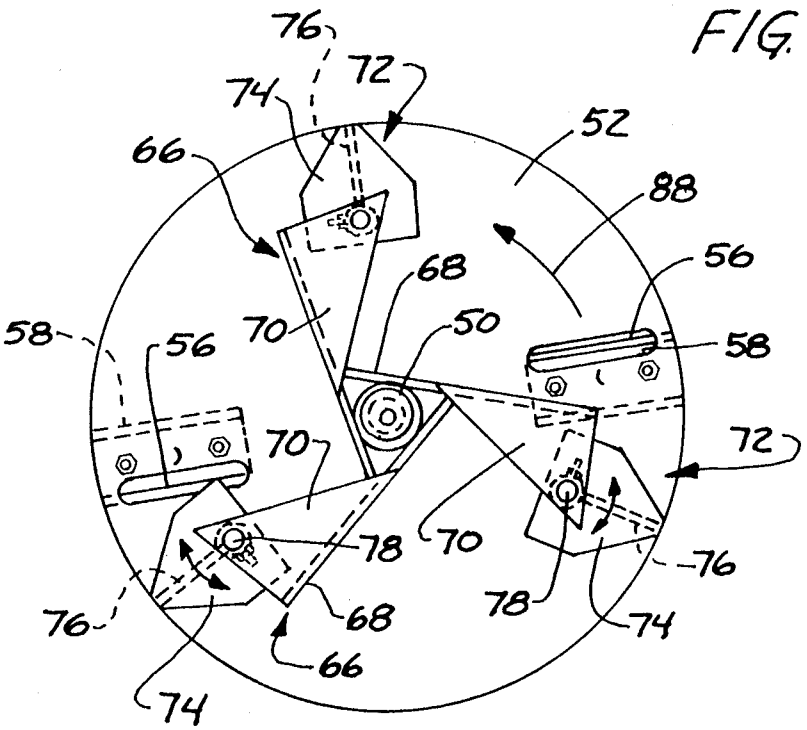
FIG. 4 is a bottom plan view of a first form of a rotor used with the chipper shredder of the present invention.

The rotor assembly has downwardly projecting rotor fan blades illustrated generally at 66 thereon. These fan blades 66, as shown in FIG. 4, are solid walls perpendicular to the plate 52 and arranged around the hub 50. The blades extend outwardly along straight planes, but they are arranged so that they are parallel to radial lines, but offset. The inner ends of the blades rest on the outer surface of the hub 50. The blades extend approximately two-thirds to three-quarters of the radius of the plate 52 and thus terminate inwardly from the outer periphery.

The blades are formed to have flat, planar face panels 68, and are bent over to form overhanging support gussets 70 adjacent their outer ends. The support gussets 70 are generally parallel to and spaced from the bottom surface of the rotor plate 52, and form a type of stirrup or holder for shredder flail assemblies, indicated generally at 72. The shredder flail assemblies each comprise a plurality of individually, pivotally mounted sickle knife sections indicated at 74, and independently pivoted flat fan blade spacers 76. This can perhaps best be seen in FIG. 9, as typically shown. The rotor plate 52 has an aperture therethrough that aligns with an aperture in the flange or gusset 70, so that a pin 78 can be passed through these apertures. The pin 78 also passes through a hub 80 or 80A that are mounted on the respective blades 76. The hub 80A has a cross hole that aligns with the bore in the pin 78, and a lock bolt 82 can be used for locking pin to hold the shredder flail assembly in place, and preventing the pin 78 from escaping. The spacers 76 are free to rotate, by either pivoting the pin 78 (for the spacer having hub 80A) or pivoting on the pin 78, as will be done for the spacer having the hub 80. The individual sickle knife sections 74 can freely swing on the pin 78 as well, and will move under centrifugal force when the rotor assembly is rotated under power.

As shown in FIG. 9, one sickle knife section 76 is mounted adjacent the inner side of gusset 70, and then a pivotally mounted blade spacer is mounted. This blade spacer separates the one sickle knife section from a second sickle knife section. Then a second blade spacer is positioned adjacent rotor plate 52.

As shown in FIG. 10, a typical sickle knife section 74 has a flat outer tip end 74A, and is an irregular hexagon. Tapered serrated edges 74B are provided. A back edge 74C joins side edges 74D, which meet the tapered serrated edges 74B. An opening 74E is provided adjacent the edge 74C and centered on the width of the sickle knife section. The sickle knife sections can be replaced, and the serrated edges help in shredding and tearing the material as material moves outwardly on the rotor fan blades during operation.

Figure 6:
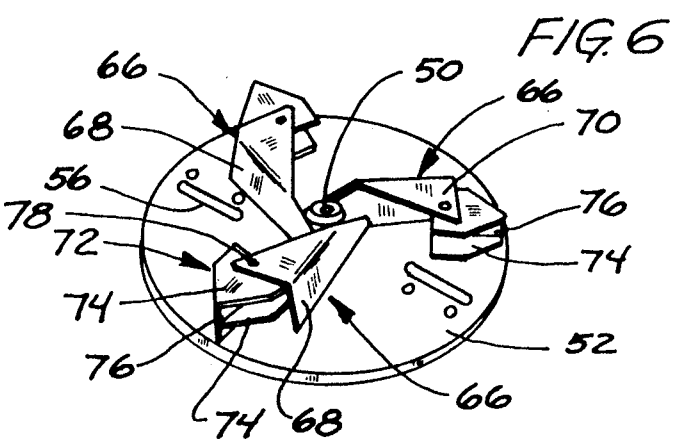
FIG. 6 is a perspective view of the rotor of FIG. 4.
Figure 5:
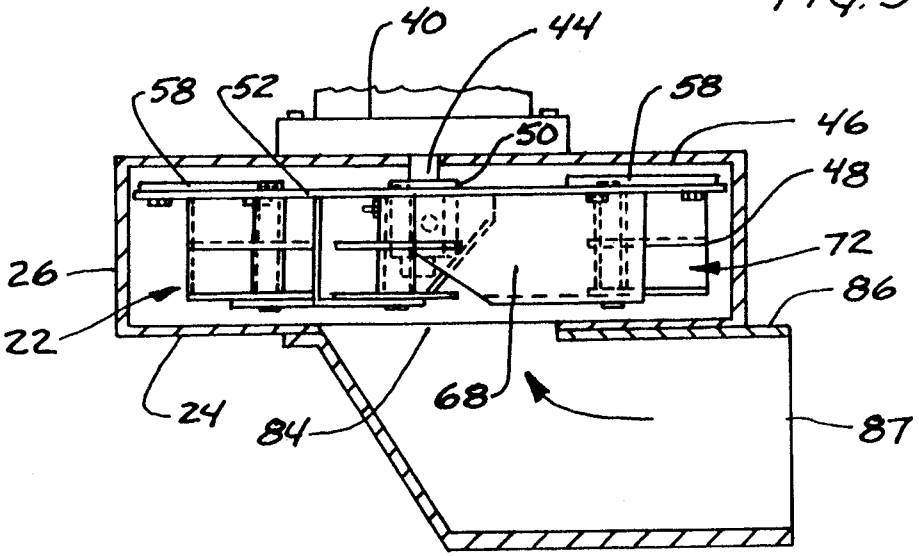
FIG. 5 is a side elevational view of the rotor of FIG. 4.

As shown in FIGS. 4, 5 and 6, the rotor can have three first stage blades comprising plates 68, and three shredding flail assemblies or members 72 made up of the individual sickle knife sections and intermediate blade spacers that form a second fan or blower stage. The spacer blades will move to extend radially outwardly under centrifugal force generated by rotating the rotor in use. The inner rotor fan blades will blow air outwardly and form a vacuum in the center of and on the bottom side of the plate 52. In turn, this vacuum will be provided through an opening 84 formed in the bottom wall 24 of the rotor housing. A feed chute or duct 86 is open to the opening 84, and has side walls, a bottom and a top wall defining an inlet opening 87 through which vacuum will be provided to provide for an inlet flow of air, so that materials to be shredded will be inducted into the chute 86 and then up through the opening 84 and into the center of the rotor. The rotor fan blade members 68 will force the material outwardly as the rotor is rotated in the direction indicated by the arrow 88, and when the material moves outwardly it will be engaged by the shredder flail assemblies 72, and will be shredded fully and then discharged out through the discharge opening and chute 36.

Figure 1:
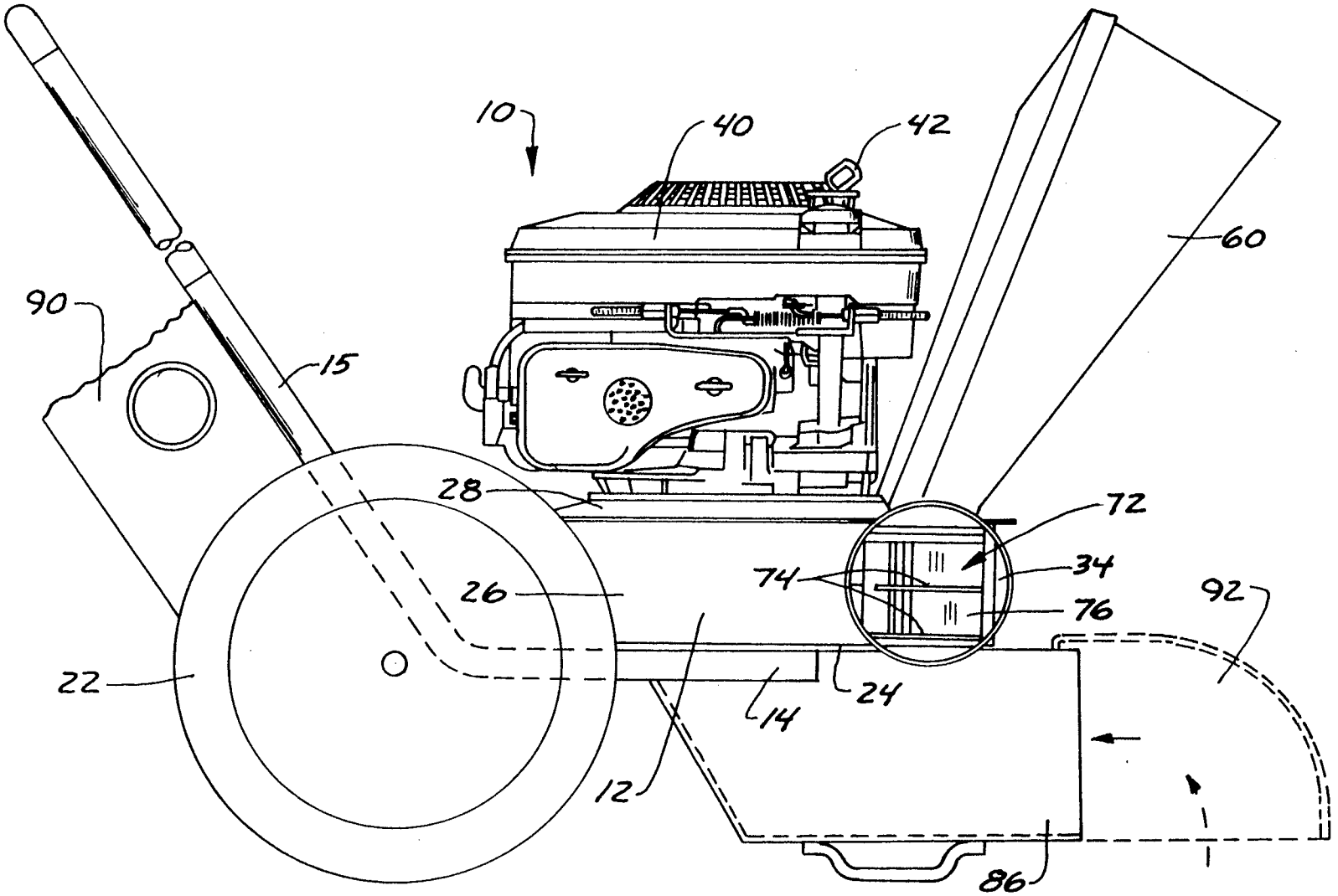

A suitable bagging attachment can be attached to the remote hose or conduit 38 by fastening it to the handles, and this is shown only schematically in FIGS. 1 and 2 at 90. This would be similar to a rear bagging mower compartment with a curved chute that goes from the outlet fitting 36 to the rear. Additionally, the vacuum in the duct 86 can be directed downwardly by mounting a removable hood or snout 92 thereon, which is indicated at dotted lines in FIG. 1, to form an area of vacuum overlying a supporting surface such as a sidewalk, to permit sucking up materials on the sidewalk itself. The forwardly facing opening of duct 86 also acts to collect material under vacuum.

As shown in FIG. 3A, leaf pan or hopper 95 can be attached to duct 86. The leaf hopper 95 has an open top and tapered side walls 96 that lead to the opening 887. Leaves can thus be raked into the hopper 95 and the vacuum will draw them into the rotor in an even feed.

A modified rotor is shown in FIGS. 7 and 8. FIG. 7 is a top view of a rotor assembly 110, which has a rotor disk or plate 112 corresponding to plate 52. On the top of this plate 112, there are chipper blades 114 suitably bolted in place adjacent slots or apertures 116 that are shown in FIG. 8. The top surface of the plate is planar, except for the chipper blades 114, and when the unit is rotated as indicated by the arrow 117, the chipper blades will be in position below the chute 60 so that limbs can be chipped as the rotor is rotating.

The underside of the plate 112 has two rotor fan blade assemblies 120, positioned at substantially 180° from each other, but offset as shown. These blade assemblies are affixed to a center hub 122 that, in turn, mounts onto the motor shaft 44, which holds the rotor in place. The rotor fan blade assemblies again have blade spacer members 126, that extend perpendicular to the plane of the plate 112 and extend outwardly from the center of the plate. A flange 128 is bent 90° to the respective plate member 126, and is provided with apertures that align with apertures in the plate 112 to receive pins 78 for holding shredder flail assemblies 72 that are identical to the flail assemblies of the previous invention. These flail assemblies 72 comprise individual sickle knife sections 74, 74 that are held apart with a blade spacer 76 and held spaced from the bottom surface of the plate 112 with a second blade spacer. The shredder flail assemblies 72 can be held in place with suitable bolts passing through the pin 78 as previously described. Reinforcing plates 132 can be provided on the bottom surface of the plate 112 and also contain slots 134 which align with the slots 116 in the plate 112, so that chips that are removed by the cutting blades or chipper blades 114 will pass through these slots and be engaged by the rotor blades, impelled outwardly and discharged.

The vertical shaft drive with a generally horizontal plate for the rotor permits the material to be shredded to be introduced into the rotor from the bottom, through a suitable duct such as that shown at 86, and having a forwardly directed opening. The material is then impelled outwardly in a two-stage fan rotor by having rotor fan blades that extend perpendicular to the plate (generally parallel to the axis of rotation) and extend out from the center in the range of two-thirds to three-quarters of the way from the center of rotation of the rotor plate to the outer peripheral edge. Flail assemblies comprising shredder blades and blade spacers will engage material and impel material being moved out by the first stage fan blades for shredding and discharge.

The two stage rotor construction is also beneficial with a horizontal shaft rotor for impelling material outwardly and for drawing material into the rotor under vacuum.

The blower or fan formed by the rotor has capacity with an auxiliary hose 38 in place it can be used for blowing off driveways and the like and for miscellaneous cleaning. The chipper chute will accommodate limbs up to three inches in diameter, as is conventionally done with existing chipper shredders. The additional features of having vacuuming ability by mounting a hood or snout at the inlet end of the duct 86, provides for a wide variety of vacuum or cleaning jobs. An adapter plate 99 can be attached to the duct 86 as shown in FIG. 3A and it has a vacuum hose 100 attached to a fitting on the plate 99. A nozzle 101 having a handle for manipulation can be attached to hose 100 for remote vacuuming.

A rear bagger attachment 90 can be added easily and connected to the outlet tube 36 for holding material that has been shredded, so that the unit could be moved across a lawn and shredded as it was moved. Folding handles of conventional design can be used as well. Free swinging sickle sections provide adequate forces for shredding materials. The use of vertical shaft motors tends to make the unit more compact, as well as reasonable in cost because of the wide use of vertical shaft motors in lawn mowers and the like.

Although the present invention has been described with reference to preferred embodiments, workers skilled in the art will recognize that changes may be made in form and detail without departing from the spirit and scope of the invention.

What is claimed is:

1. A chipper shredder apparatus comprising a housing, a chipping and shredding rotor mounted for rotatable movement within the housing, an engine mounted on said housing, said engine being mounted on a top wall of said housing and having a drive shaft that extends substantially vertically downwardly, said rotor being mounted on said engine shaft within said hosing, said housing having an opening in a bottom wall thereof, and said rotor having blade means thereon for generating a flow of air radially outwardly of the rotor and inwardly toward the rotor through the opening in the bottom wall of the housing for introducing material into the rotor, said rotor blade means comprising a blade member on the rotor that has a plane that extends generally parallel to an axis of rotation of the rotor, and being supported on a rotor backing member and extending part way outwardly from adjacent the axis of rotation of the rotor toward an outer periphery of the rotor backing member, a shredder flail assembly mounted at an outer end of the blade member, said shredder flail assembly being pivotally mounted about a second axis that extends generally parallel to the axis of rotation of the rotor.

2. The apparatus as specified in claim 1, wherein said opening in the bottom wall of the housing opens to a duct member that has walls defining a path of air movement and has a laterally facing opening below the housing.

3. The apparatus as specified in claim 2 and means on said housing to direct the opening of said duct member in a desired direction for performing vacuum pickup operations.

4. The apparatus as specified in claim 1, wherein said shredder flail assembly comprises at least one serrated sickle knife section, the second axis being positioned substantially midway between lateral side edges of the sickle knife section, and a blade-like spacer member mounted for pivotal movement about the same axis as said sickle knife section and having a plane parallel to the pivot axis.

5. The apparatus as specified in claim 1, wherein said rotor backing member comprises a plate member having a plane generally perpendicular to the axis of rotation of the rotor, and said rotor blade means and said shredder flail assemblies being mounted on said plate member.

6. The apparatus as specified in claim 5 and at least one chipper knife mounted on an upper side of said plate member, and having a cutting blade that is rotationally leading when the rotor is rotated, and a guide chute mounted to said housing and aligned with said chipper knife whereby limbs can be pressed through said guide chute into said housing to engage said chipper knife.

7. A rotor for a chipper shredder comprising a plate adapted for attachment to a vertical shaft for rotation about a central axis, and a plurality of rotor blades mounted on said plate on one side thereof, said rotor blades each including a wall member that extends generally perpendicular to the plate and an outer end which extends outwardly from the central axis, and terminates short of a peripheral edge of said plate, said rotor blades each having a flange thereon overlying a portion of the plate, and a plurality of shredder flail assemblies each pivotally mounted to the flange and the plate adjacent a respective outer end of one of the rotor blades, said shredder flail assemblies each including a serrated edge sickle knife positioned parallel to and between the plate and the flange, and a second blade perpendicular to the sickle knife and pivoting with the sickle knife.

8. An apparatus for shredding branches, twigs, leaves or lawn debris, including a housing having a cavity; a rotor disposed in said housing for rotation about a central axis; means for movably mounting said housing for movement on a supporting surface and supporting the housing so that the central axis is substantially upright, a power unit mounted on said housing on an upper side thereof, and having an upright drive shaft that supports and drives the rotor inside the housing cavity; the rotor comprising a plate having a plane generally perpendicular to the central axis and having a plurality of blades which extend from adjacent a center portion of the plate toward an outer periphery of the plate, the blades being generally perpendicular to the plane of the plate and having outer portions terminating inwardly from the outer periphery; and a plurality of pivoting shredder assemblies each said shredder assembly pivotally mounted adjacent the outer portion of one of said blades to shred material being moved by said blades outwardly toward the periphery of the plate.

9. The apparatus as specified in claim 8, wherein said shredder assemblies comprise at least one shredder blade having edges that taper toward an outwardly extending end from a location adjacent the pivotal mounting of the shredder assembly, and a fan blade member pivotally mounted on the same pivot as the shredder assembly and having a plane generally perpendicular to the shredder blade.

10. The apparatus as specified in claim 9, wherein in each shredder assembly there are at least two shredder blades, and at least two of said fan blade members, said fan blade members being positioned to space the shredder blades apart, and to space the shredder blades from the plate, said fan blade members adding additional impetus to material being moved outwardly along the plate as the rotor is rotated.

11. The apparatus as specified in claim 8, wherein the shredder assemblies are each pivotally mounted to the plate about a pivot axis which rotational trails the respective associated blade.

12. The apparatus as specified in claim 8, wherein said blades are parallel to radial lines extending from the central axis of the rotor, but are offset from the axis.

13. The apparatus as specified in claim 8, and at least one chipper blade mounted on said plate on an upper side thereof, an opening in the housing aligning with the path of movement of said chipper blade, and guide means for guiding limbs through the opening in the housing for engaging the chipper blade for chipping material.

14. The apparatus as specified in claim 8, wherein said housing has an inlet opening on a side thereof adjacent center portions of the rotor, and a duot member leading from said inlet opening and providing a duct opening for receiving materials, said blades generating an air flow, including a vacuum at the duct opening for drawing materials into said rotor and impelling them outwardly toward said shredder assemblies.

15. The apparatus as specified in claim 14 and a removable hopper mountable relative to the housing and having an outlet opening aligning with the duct opening of the duct member to permit materials to be placed in the hopper for feeding to the duct opening in the duct member.

16. The apparatus as specified in claim 8, wherein said blades on said plate generate a vacuum air flow adjacent center portions of said rotor, an opening in the housing adjacent the center portions of the rotor for permitting air to enter said cavity, and an outlet opening at an outer peripheral portion of said housing to permit air under pressure to exit said cavity as the rotor is being rotated.

17. The apparatus of claim 16 and means for providing a vacuum hose fitting in a flow path leading to an opening in the housing.

18. The apparatus of claim 16 and a tubular conduit connected to the outlet opening for directing the air under pressure to a selected location.

19. The apparatus of claim 18 and a bag for storing debris mounted relative to the housing, the tubular conduit being connected to an interior of the bag.

20. An apparatus for shredding branches, twigs, leaves or lawn debris, including a housing having a cavity; a rotor disposed in said housing for rotation about a central axis; the rotor comprising a plate having a plane generally perpendicular to the central axis and having a plurality of first blades which extend from adjacent a center portion of the plate toward an outer periphery of the plate, the first blades being generally perpendicular to the plane of the plate and having outer portions terminating inwardly from the outer periphery; and a plurality of pivoting shredder flail assemblies pivotally mounted adjacent the outer portions of each of said first blades to shred material being moved by said first blades outwardly toward the periphery of the plate; said shredder assemblies each comprising at least two shredder blades having edges that taper toward an outwardly extending end from a location adjacent the pivotal mounting of the shredder assemblies, and at least two second fan blade members pivotally mounted on the same pivot as the respective shredder assemblies, each second fan blade member having a plane generally perpendicular to the shredder blades; said second fan blade members of each shredder flail assembly being positioned to space the shredder blades apart, and to space the shredder blades from the plate, said fan second blade members adding additional impetus to material being moved outwardly along the plate by the first blades as the rotor is rotated.

* * * * *

UNITED STATES PATENT AND TRADEMARK OFFICE

CERTIFICATE OF CORRECTION

PATENT NO. : 5,240,189

DATED : August 31, 1993

INVENTOR(S) : Majkrzak et al

It is certified that error appears in the above-indentified patent and that said Letters Patent is hereby corrected as shown below:

Column 6, line 32, delete "hosing", insert --housing--.

Column 8, line 13, delete "duot", insert "duct".

Signed and Sealed this

Nineteenth Day of April, 1994

Bruce Lehman

*Attest:*

BRUCE LEHMAN

*Attesting Officer*

*Commissioner of Patents and Trademarks*